United States Patent [19]

Kirkpatrick et al.

[11] 4,342,253

[45] Aug. 3, 1982

[54] SPROCKET ARRANGEMENT IN A HIGH RATE OF FIRE REVOLVING BATTERY GUN

[75] Inventors: Robert G. Kirkpatrick, Shelburne; Stephen A. Jarvis, Colchester, both of Vt.

[73] Assignee: General Electric Company, Burlington, Vt.

[21] Appl. No.: 137,704

[22] Filed: Apr. 7, 1980

[51] Int. Cl.[3] ..... F41D 10/30

[52] U.S. Cl. ..... 89/12; 89/33 CA

[58] Field of Search ..... 89/12, 33 B, 33 BA, 89/33 BC, 33 CA

[56] References Cited

U.S. PATENT DOCUMENTS

| | | | |
|---|---|---|---|
| 125,563 | 4/1872 | Gatling | 89/12 |
| 199,915 | 2/1878 | Leland | 89/12 |
| 2,648,258 | 8/1953 | Simpson | 89/33 CA |
| 3,333,506 | 8/1967 | Henshaw et al. | 89/33 CA |
| 3,380,342 | 4/1968 | Chiabrandy | 89/12 |
| 3,429,221 | 2/1969 | Kirkpatrick | 89/33 BC |
| 3,683,743 | 8/1972 | Stoner | 89/33 B |
| 3,915,058 | 10/1975 | Folsom et al. | 89/172 |

OTHER PUBLICATIONS

FIG. 56 in Technical Report AFATL-TR-73-130, vol. 1, Jun. 1973.

FIG. 14 in Technical Report ADTC-TR-73-66, Sep. 1973.

*Primary Examiner*—Stephen C. Bentley

*Attorney, Agent, or Firm*—Bailin L. Kuch

[57] ABSTRACT

A feature of this invention is the provision of a Gatling type gun having a reduced diameter main cam provided by a rear dwell increment of angular rotation of the rotor which in turn is provided by a feed system wherein the bolt comes forward out of rear dwell after the round is placed upon the face of the gun bolt but before the round is centered on the face of the gun bolt. This is accomplished by permitting controlled longitudinal motion of the round while it is still being provided with transverse motion by the sprocket.

3 Claims, 12 Drawing Figures

84RF
84
84RM
84RA
96
86RF
86RM
92
GBC
RC
84

94
96
92
96R
94R
92R
92W 96
94W 94
96W

SPROCKET ARRANGEMENT IN A HIGH RATE OF FIRE REVOLVING BATTERY GUN

BACKGROUND OF THE INVENTION

1. Field of Art

This invention relates to a sprocket arrangement for feeding rounds onto the face of a gun bolt.

2. Prior Art

The classic modern revolving battery gun is shown by R. J. Gatling in U.S. Pat. No. 125,563 issued Apr. 9, 1872. A stationary housing encloses and supports a rotor assembly which has a plurality of gun barrels and a like plurality of gun bolts. Each gun bolt is reciprocated longitudinally by a stationary elliptical cam track in the housing. The rounds are fed in forward of each gun bolt when the bolt is in rear dwell, and the bolt picks up its respective round as it comes forward. In the feeding systems shown in U.S. Pat. Nos. 3,333,506 issued to R. W. Henshaw et al. on Aug. 1, 1967 and 3,380,342, issued to R. E. Chiabrandy on Apr. 30, 1968, there is shown the conventional system of a sprocket turning within spiral shaped guides for feeding rounds onto the face of a gun bolt while the bolt is in rear dwell. This is the system utilized in the M61 Vulcan gun and used in the declutching feeder or the transfer unit therefor. A similar system is utilized in the GAU-8/A gun. A different system, utilizing an expanding feeder sprocket, was utilized in a different, prototype version of the GAU-8/A gun, as shown in FIG. 56 of Technical Report AFATL-TR-73-130, Vol. 1, June 1973. Another different system, utilizing a non-constant rotational velocity sprocket is shown in U.S. Pat. No. 3,915,058 issued to Folsom et al. on Oct. 28, 1975. In all of these systems the bolt remains in rear dwell until the round is centered on the face of the gun bolt.

The rear dwell time, i.e., the increment of angular rotation of the rotor required for the gun bolt to remain in rear dwell, is one of the determinants of the increment of angular rotation of the rotor available for the acceleration, constant velocity and deceleration of the gun bolt. The greater the increment available for such acceleration, constant velocity and deceleration, for a given maximum cam slope, the smaller the diameter of the cam which may be used. The smaller the cam diameter, the smaller the diameter of the gun, and also the lower the power required to drive the gun.

SUMMARY OF THE INVENTION

It is an object of this invention to provide a Gatling type gun having a reduced diameter main cam.

A feature of this invention is the provision of a Gatling type gun having a reduced diameter main cam provided by a rear dwell increment of angular rotation of the rotor which in turn is provided by a feed system wherein the bolt comes forward out of rear dwell after the round is placed upon the face of the gun bolt but before the round is centered on the face of the gun bolt. This is accomplished by permitting controlled longitudinal motion of the round while it is still being provided with transverse motion by the sprocket.

BRIEF DESCRIPTION OF THE INVENTION

These and other objects, features and advantages of the invention will be apparent from the following specification thereof taken in conjunction with the accompanying drawing in which.

THE PREFERRED EMBODIMENT

Figure 1:
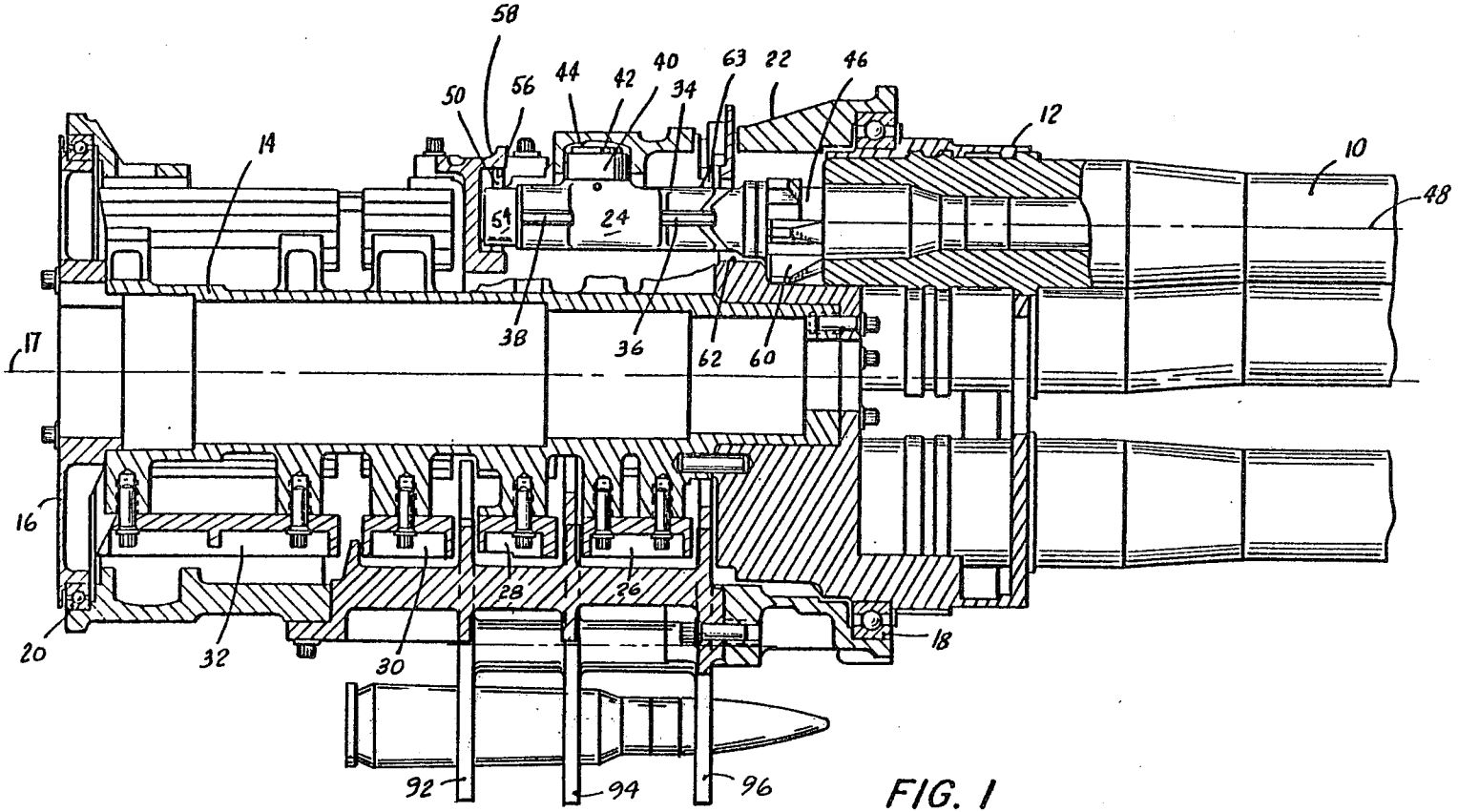
FIG. 1 is a longitudinal cross-section of the housing and contents of a Gatling type gun embodying this invention.

The Gatling gun shown in FIG. 1 has a bolt locking system which is broadly of the type shown in U.S. Pat. No. 3,611,871 issued to R. G. Kirkpatrick et al. on Oct. 12, 1971 and in the GAU-8/A gun described in Technical Report ADTC-TR-73-66 of September, 1973. Reference may be had to U.S. Pat. No. 3,611,871, the disclosure of which is hereby incorporated by reference for subject matter omitted herein. The gun bolt in U.S. Pat. No. 3,611,871 has a telescoping two-part body, while the gun bolt in the GAU-8/A gun, shown in FIG. 14 of the report, has a rigid body. In each case, the longitudinal reciprocation of the gun bolt is controlled by a stationary main cam track in the gun housing driving a cam follower or roller mounted to the gun bolt on a radial axis, and the locking and unlocking rotation of the head of the bolt is controlled by a stationary cam track in the gun housing driving a cam follower mounted to the gun bolt on an axis which is parallel to and spaced from the longitudinal axis of the gun bolt.

The gun includes a plurality, e.g., five, of gun barrels 10, fixed to a forward rotor 12, which is fixed to an aft rotor 14, which is fixed to an aft cover 16, and are all journaled for rotation about a longitudinal axis 17 by a forward bearing 18 and an aft bearing 20, in a stationary three-part housing 22. A plurality, e.g., five, of sets of tracks are bolted to the rotor, to receive between adjacent sets a like plurality of gun bolts 24. Each set includes tracks 26, 28, 30 and 32. Each gun bolt assembly 24 includes a bolt carriage or body 34 having slides 36, 38 which engage the tracks of the rotor. A gun bolt roller or cam follower 40 is journaled to a headed pin 42 which is fixed on a radial axis to the bolt body 34. This roller 40 rides in the main cam track 44 formed in the housing 22. As the rotor assembly 12, 14 rotates with its gun bolts 24, the main cam track 44 reciprocates the gun bolts to and between their forward and aft dwells. A breech bolt or bolt head 46 is journaled in the bolt body 34 for limited oscillation abouts its longitudinal axis 48.

A linear rotary motion roller 50 is journaled on a headed pin which is fixed to a cam follower 54 on an axis which is parallel to and spaced from the longitudinal axis of the bolt head. The cam follower is fixed to and coaxial with the bolt head. During front dwell of the gun bolt the roller 50 engages a cam track 56 formed in a locking cam 58 which is fixed to the gun housing 22. As the rotor assembly rotates, the cam track 56 oscillates the bolt head 46 about its longitudinal axis 48 from unlock to lock to unlock, whereby the locking lugs 60 on the bolt head engage and disengage with the locking lugs 62 formed in the forward rotor 12 adjacent the aft ends of the gun barrels 10.

Figure 2:
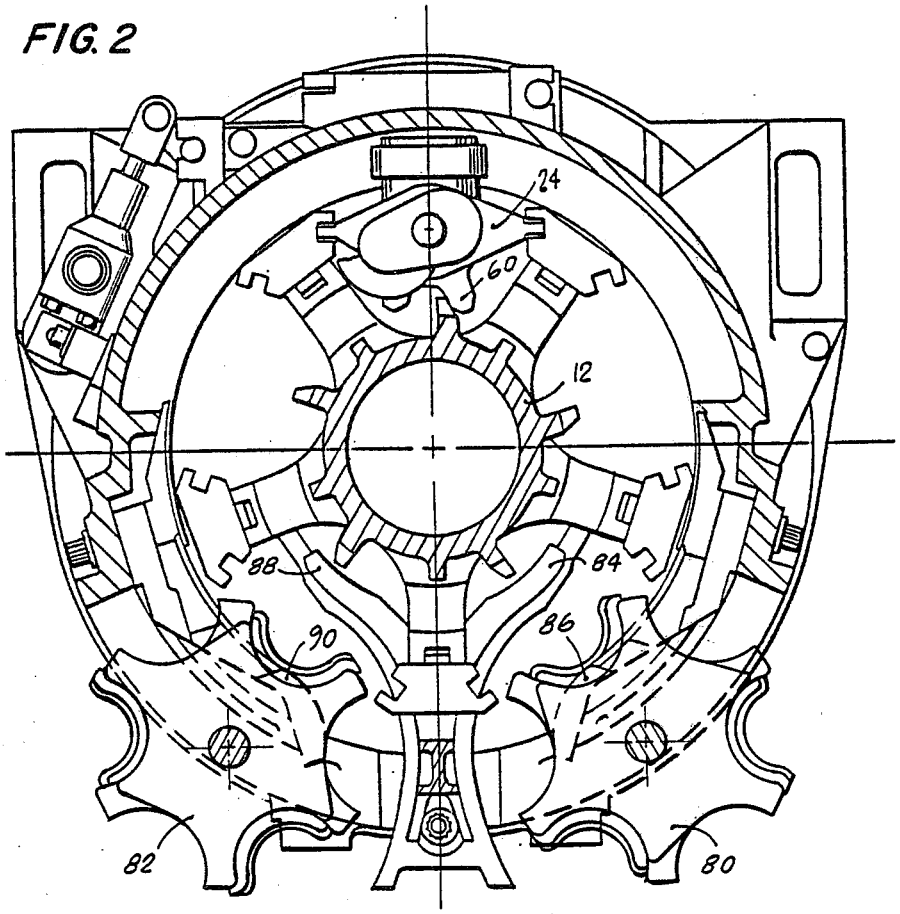
FIG. 2 is a transverse cross-section of the gun of FIG. 1 showing the feeder sprockets.
Figure 3:
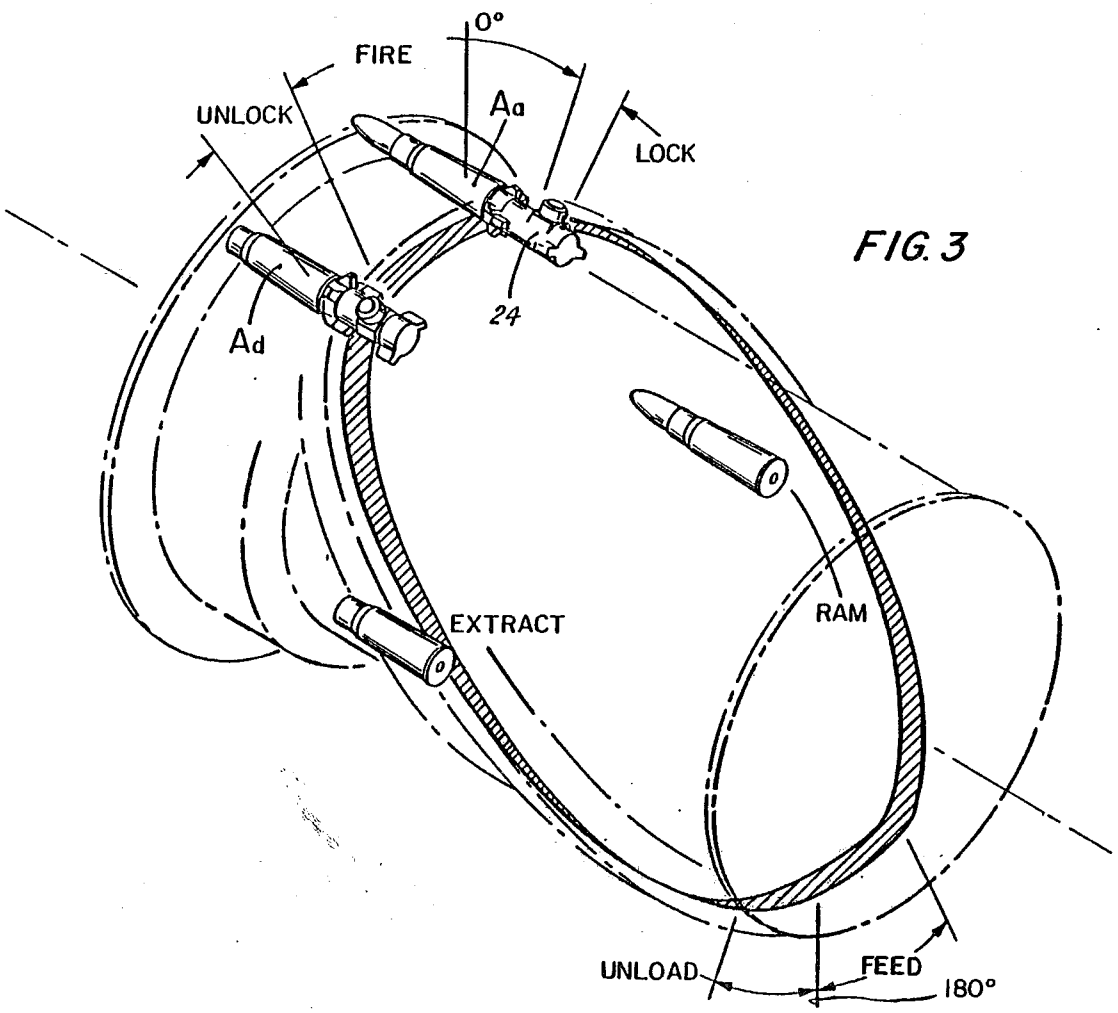
FIG. 3 is a schematic of the main cam and the cycle of operation of the gun provided by the cam.

Rounds of ammunition are fed to the gun bolts by an in-feed sprocket assembly 80 and fired cases are received from the gun bolts by an out-feed sprocket assembly 82 as seen in FIG. 2. The rounds are controlled by an inner guide assembly 84 and an outer guide assembly 86 fixed to the gun housing adjacent the in-feed sprocket, and the fired cases are controlled by an inner guide assembly 88 and an outer guide assembly 90. This inner guide assembly includes three right hand blades 84RA, 84RM and 84RF and three symmetrical left hand blades. The outer guide assembly includes two right hand blades 86RM and 86RF.

Each sprocket assembly includes an aft blade 92 which engages the base of the case of the round of ammunition, a middle blade 94 which engages the middle portion of the case, and a forward blade 96 which engages the projectile. Each sprocket assembly may be coupled to an endless constant velocity conveyor mechanism as shown in U.S. Pat. No. 3,429,221 issued to R. G. Kirkpatrick on Feb. 25, 1969 for the hand-off of rounds or fired cases. Each of the blades has three hollows, respectively 92R, 94R and 96R, for receiving rounds of ammunition, and three cutouts, respectively 92W, 94W and 96W, for reducing the weight of the blade.

Figures 4A, 4B, 5A, 5B, 6A, 6B:
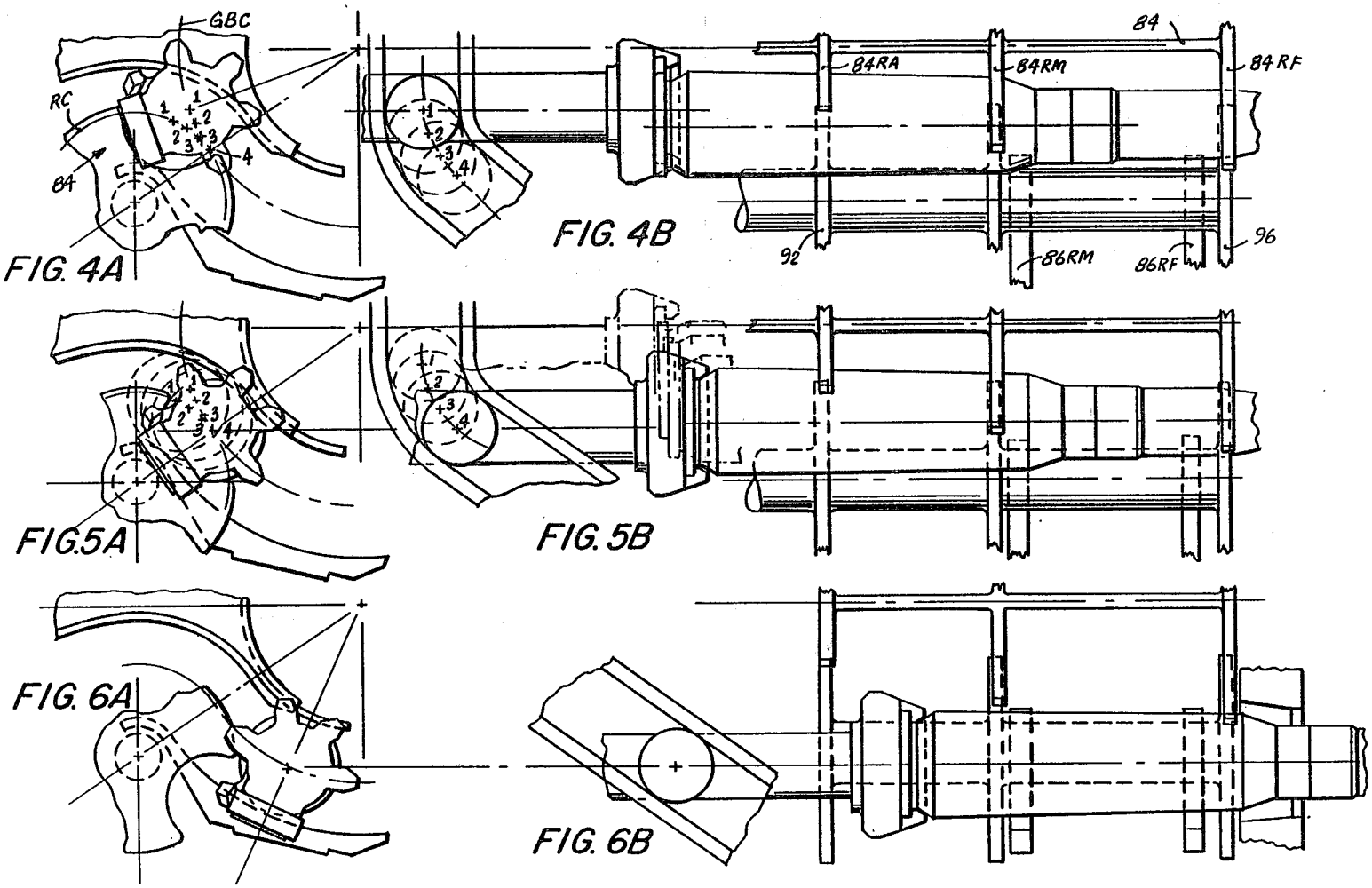
FIG. 4A is a transverse detail view showing the interaction of round of ammunition, the sprocket, the guides and the gun bolt with the bolt still in rear dwell.
FIG. 4B is a longitudinal view showing the round of ammunition, the sprocket, the gun bolt and the main cam at the same time as that shown in FIG. 4A.
FIG. 5A is similar to FIG. 4A, but with the gun bolt out of rear dwell and the round still engaged by the sprocket.
FIG. 5B is similar to FIG. 4B but at the same time as that shown in FIG. 5A.
FIG. 6A is similar to FIG. 4A, but with the gun bolt out of rear dwell and the round out of the sprocket.
FIG. 6B is similar to FIG. 4B but at the same time as that shown in FIG. 6A.
Figures 7A, 7B, 7C:
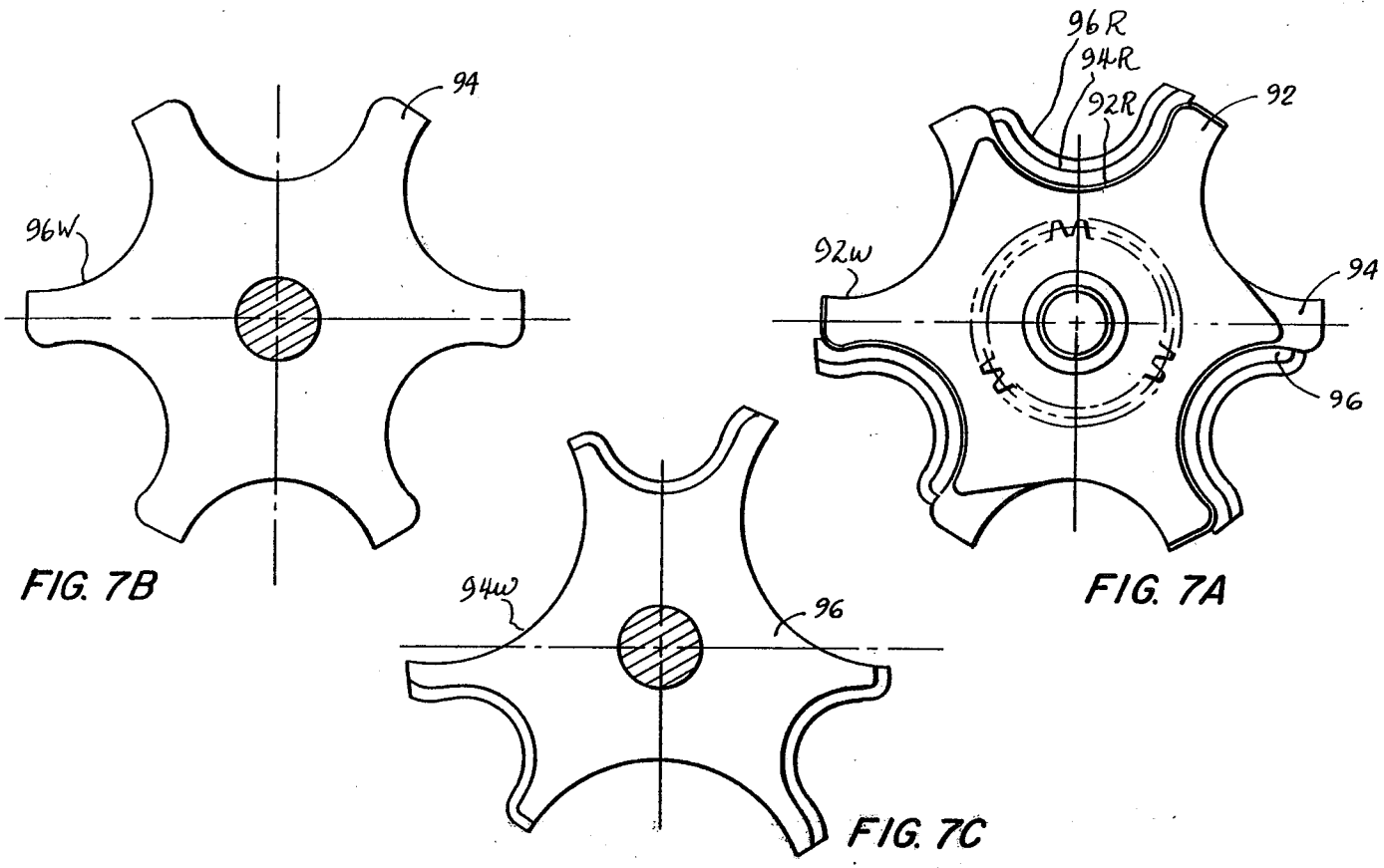
FIG. 7A is a transverse detail view looking forward of the in-feed sprocket.
FIG. 7B is a transverse detail view of the middle blade of the in-feed sprocket.
FIG. 7C is a transverse detail view of the forward blade of the in-feed sprocket.

The sequence of the handing of a round of ammunition by the in-feed sprocket assembly 80 onto the face of the gun bolt is shown in FIGS. 4A through 6B. In FIGS. 4A and 4B the gun bolt is shown approaching the very end of its rear dwell, at position one, with the longitudinal axis of the round of ammunition eccentric to the longitudinal axis of the gun bolt. The round is captured in the hollows of the blades of the sprocket assembly between the blades of the inner guide assembly and the blades of the outer guide assembly, and the extractor groove of the gun bolt, providing complete control of the round. In other words, the round is not free to wobble out of parallel with respect to the gun bolt and the gun barrel. The circle GBC of the center line of the gun bolt and the circle RC of the center line of the round in the sprocket are not co-tangent at position. In other words, the gun bolt and the round, at position one, are eccentric.

As the gun bolt moves from position one out of dwell, through positions two and three, the round moves not only transversely across the face of the gun bolt toward the concentric relationship of position four, but also forwardly as the gun bolt itself moves forwardly. The round remains under full control as it is still captured in the hollows of the blades of the sprocket assembly between the blades of the inner guide assembly and the blades of the outer guide assembly and the extractor groove of the gun bolt, through position four. However, the round is moving forwardly through the hollows of the blades of the sprockets, and across the blades of the inner and outer guide assemblies.

Although full control by the sprocket assembly ends past position four whereat the round starts riding out of the bottom of the hollow and rides along the driving side of the hollow, full transverse control is still provided by the inner and outer guide assemblies.

The full control of the round by the guide assemblies continues until the neck of the case of the round has entered the aperture 100 defined by the locking lugs of the rotor adjacent the chamber of the gun barrel chamber. From this point forward full control is provided internally in the gun by the gun bolt, the housing and the chamber.

What is claimed is:

1. A gun including:

a housing having a main cam and a longitudinal axis;

a rotor, having a plurality of gun barrels disposed in an annular row about said axis, and a like plurality of gun bolts disposed in an annular row about said axis, and journaled for rotation in said housing about said axis;

each of said gun bolts having a cam follower engaged with said main cam whereby as said rotor and said row of barrels and said row of gun bolts rotate about said axis, said main cam drives each of said gun bolts in sequence longitudinally to and between an aft dwell position and a forward dwell position;

sprocket means journaled for rotation in synchronism with said rotor for handing a round of ammunition with its base onto the face of each of said gun bolts in sequence as the respective gun bolt passes through its respective rear dwell position, means interrelating said sprocket means and said main cam so that each of said gun bolts is in its respective rear dwell position as the base of the respective round of ammunition is initially handed transversely onto said face of said gun bolt, but not coaxial with said gun bolt, and subsequently said gun bolt, as said rotor rotates about said axis, proceeds to move longitudinally forwardly while the round, as said sprocket rotates, continues to move transversely along the face of said gun bolt to a disposition whereat the round is coaxial with said gun bolt.

2. A gun according to claim 1 wherein:

said sprocket means is journaled for rotation about a longitudinal axis which is parallel to said housing longitudinal axis and includes a first plurality of blades, each blade having a second plurality of cutouts to form a second plurality of sets of longitudinally aligned cutouts, said cutouts being so constructed and arranged as to provide transverse control of each round while such round is moving longitudinally with the respective gun bolt through a set of said cutouts.

3. A gun according to claim 2 further including:

a pair of stationary guides secured to said housing and adjacent said sprocket means, said guides being so constructed and arranged as to assist said sprocket means to provide transverse control of each round while such round is moving longitudinally with the respective gun bolt through a set of said cutouts.

* * * * *